US008659413B2

(12) United States Patent
Sutherland et al.

(10) Patent No.: US 8,659,413 B2
(45) Date of Patent: Feb. 25, 2014

(54) FLUID LEVEL MONITORING SYSTEM AND METHOD

(75) Inventors: Thomas M. Sutherland, Montgomery, IL (US); Austin D. Ehle, Mt. Pulaski, IL (US); Randy Aneloski, Channahon, IL (US); Luke J. Daiberl, Park Ridge, IL (US); Jack Elder, Aurora, IL (US)

(73) Assignee: Caterpillar Inc., Peoria, IL (US)

( * ) Notice: Subject to any disclaimer, the term of this patent is extended or adjusted under 35 U.S.C. 154(b) by 661 days.

(21) Appl. No.: 12/953,157

(22) Filed: Nov. 23, 2010

(65) Prior Publication Data

US 2012/0125442 A1 May 24, 2012

(51) Int. Cl.
*B60Q 1/00* (2006.01)

(52) U.S. Cl.
USPC ..... 340/450; 340/425.5; 340/438; 340/450.1; 340/450.2; 340/450.3; 340/451; 340/452; 340/459; 340/461; 701/22

(58) Field of Classification Search
USPC ..... 340/425.5, 438, 450–452, 459, 461; 701/22
See application file for complete search history.

(56) References Cited

U.S. PATENT DOCUMENTS

| | | | | |
|---|---|---|---|---|
| 5,006,829 | A * | 4/1991 | Miyamoto et al. | 340/459 |
| 5,210,769 | A * | 5/1993 | Seidel et al. | 73/295 |
| 6,587,767 | B2 * | 7/2003 | Letang et al. | 701/34.4 |
| 6,587,768 | B2 * | 7/2003 | Chene et al. | 701/33.2 |
| 7,242,311 | B2 * | 7/2007 | Hoff et al. | 340/679 |
| RE39,845 | E * | 9/2007 | Hasfjord et al. | 340/438 |
| 2003/0188576 | A1 * | 10/2003 | Park | 73/307 |
| 2004/0204157 | A1 * | 10/2004 | Remboski et al. | 455/569.1 |
| 2005/0004724 | A1 * | 1/2005 | Fehr et al. | 701/29 |
| 2006/0200285 | A1 * | 9/2006 | Obradovich | 701/30 |

OTHER PUBLICATIONS

Product Brochure, "993K Wheel Loader," Caterpillar, Inc., 2007 (32 pages).

* cited by examiner

*Primary Examiner* — Andrew Bee
(74) *Attorney, Agent, or Firm* — Miller, Matthias & Hull

(57) ABSTRACT

A fluid level monitoring system may include a control panel having a plurality of input devices, each corresponding to a monitored fluid of a machine, and a plurality of indicators, each corresponding to one of the input devices. The indicators may provide visual displays of fluid level statuses for the monitored fluids. The fluid level monitoring system may further include a message display device that may display a fluid level status message for one of the monitored fluids based on the actuation of the corresponding input device of the control panel.

19 Claims, 10 Drawing Sheets

FLUID LEVEL MONITORING SYSTEM AND METHOD

TECHNICAL FIELD

This disclosure relates generally to large earth moving equipment and, in particular, to monitoring the levels of various fluids used in such equipment.

BACKGROUND

Large earth moving equipment is used at construction and excavation sites to add earth to or remove earth from the sites. Wheel loaders have been designed that move as much as 30 cubic yards of material in one bucket load to fill a 120 cubic yard dump truck in just four bucket loads. The size of the equipment is mammoth in scope, with the operator cab of the vehicles being 15-20 feet in the air and having access provided by stairways. This equipment, like other machines, uses many different fluids to power the equipment and ensure that parts move relative to each other without excessive wear and generation of heat. Such fluids include gasoline, diesel or other fuels, oil for the engine, steering system and implement manipulation, engine coolant, grease, windshield washer fluid and the like.

The fluids used in the equipment must be maintained at appropriate levels for the equipment to operate and to avoid damaging the mechanical components. Typically, the operator cab is provided with gauges for the operator to monitor the fluid levels during operation of the equipment. Additionally, maintenance personnel periodically inspect the equipment, including monitoring the fluid levels, to ensure that the equipment is operating properly. In these types of machines, for convenience of servicing the equipment, fluid level monitoring systems are provided at ground level. The fluid level monitoring systems allow the maintenance workers to avoid scaling the machine to get to the instruments in the operator cab, and instead allow the workers to remain on the ground where the supplies of fluid are located. Previous fluid level monitoring systems have included indicator lights for signaling when fluids are low and, for some fluids, quick fill and drainage ports allowing replenishment of the fluids at the fluid level monitoring system. Despite the information from the indicator lights, the maintenance worker must still know or guess as to the appropriate fluid brand, specifications and amount of fluid to be added. Therefore, a need exists for improved fluid level monitoring system configurations providing additional information for monitoring fluid levels and replenishing fluids without consulting additional external resources.

SUMMARY OF THE DISCLOSURE

In accordance with one aspect of the disclosure, the invention is directed to a fluid level monitoring system for a machine having an onboard information system (OIS) configured to monitor a fluid level status for each of a plurality of fluids used in the operation of the machine, wherein the OIS stores a fluid level status value for each of the monitored fluids. The fluid level monitoring system may include a control panel that may include a plurality of input devices, with each input device corresponding to one of the monitored fluids of the machine, and a plurality of indicators. Each indicator may correspond to one of the input devices, wherein the input devices and indicators may be operatively connected to the OIS, and wherein the indicators may be configured to provide a visual display of a fluid level status for each of the monitored fluids. The fluid level monitoring system may further include a message display device that may have a display screen and a processor operatively connected to the display screen and to the OIS. The processor may be programmed to cause the display screen to display a fluid level status message for one of the monitored fluids, wherein the monitored fluid for which the fluid level status message is displayed may be determined based on the actuation of the corresponding input device of the control panel.

In accordance with another aspect of the disclosure, the invention is directed to a machine having reservoirs for storing a plurality of fluids used in the operation of the machine. The machine may include an OIS that may have a plurality of fluid level sensors, each sensor being disposed at a reservoir for one of the fluids of the machine, a memory device configured to store a fluid level status for each of the fluids, and an OIS processor operatively connected to the memory device and the fluid level sensors. The OIS processor may be configured to receive signals from the fluid level sensors, to determine fluid level statuses for the fluids based on the signals received from the corresponding fluid level sensors, and to cause the memory device to store the fluid level statuses. The machine may further include a control panel mounted on an exterior of the machine that may have a plurality of input devices, with each input device corresponding to one of the fluids of the machine, and a plurality of indicators, with each indicator corresponding to one of the input devices. The input devices and indicators may be operatively connected to the OIS processor, and the OIS processor may actuate the indicators to provide a visual display of the fluid level status for each of the fluids. The machine may also include a message display device that may have a display screen, a message display device processor operatively connected to the display screen and to the OIS processor. The message display device processor may be programmed to cause the display screen to display a fluid level status message for one of the monitored fluids, and the monitored fluid for which the fluid level status message is displayed may be determined based on the actuation of the corresponding input device of the control panel.

In a further aspect, the invention is directed to a method for providing a fluid monitoring display at a fluid level monitoring system of a machine that may include determining a fluid level status for each of a plurality of fluids used in the operation of the machine, wherein each fluid is contained within a corresponding reservoir of the machine, for each fluid, actuating at least one indicator of the fluid level monitoring system to provide a visual display corresponding to the fluid level status of the fluid, detecting actuation of an input device of the fluid level monitoring system corresponding to one of the fluids, and causing a fluid level status message for the fluid to be displayed at a display screen of the fluid level monitoring system in response to the actuation of the input device corresponding to the fluid, wherein the fluid level status message corresponds to the fluid level status of the fluid.

Additional aspects of the invention are defined by the claims of this patent.

DETAILED DESCRIPTION

Figure 1:
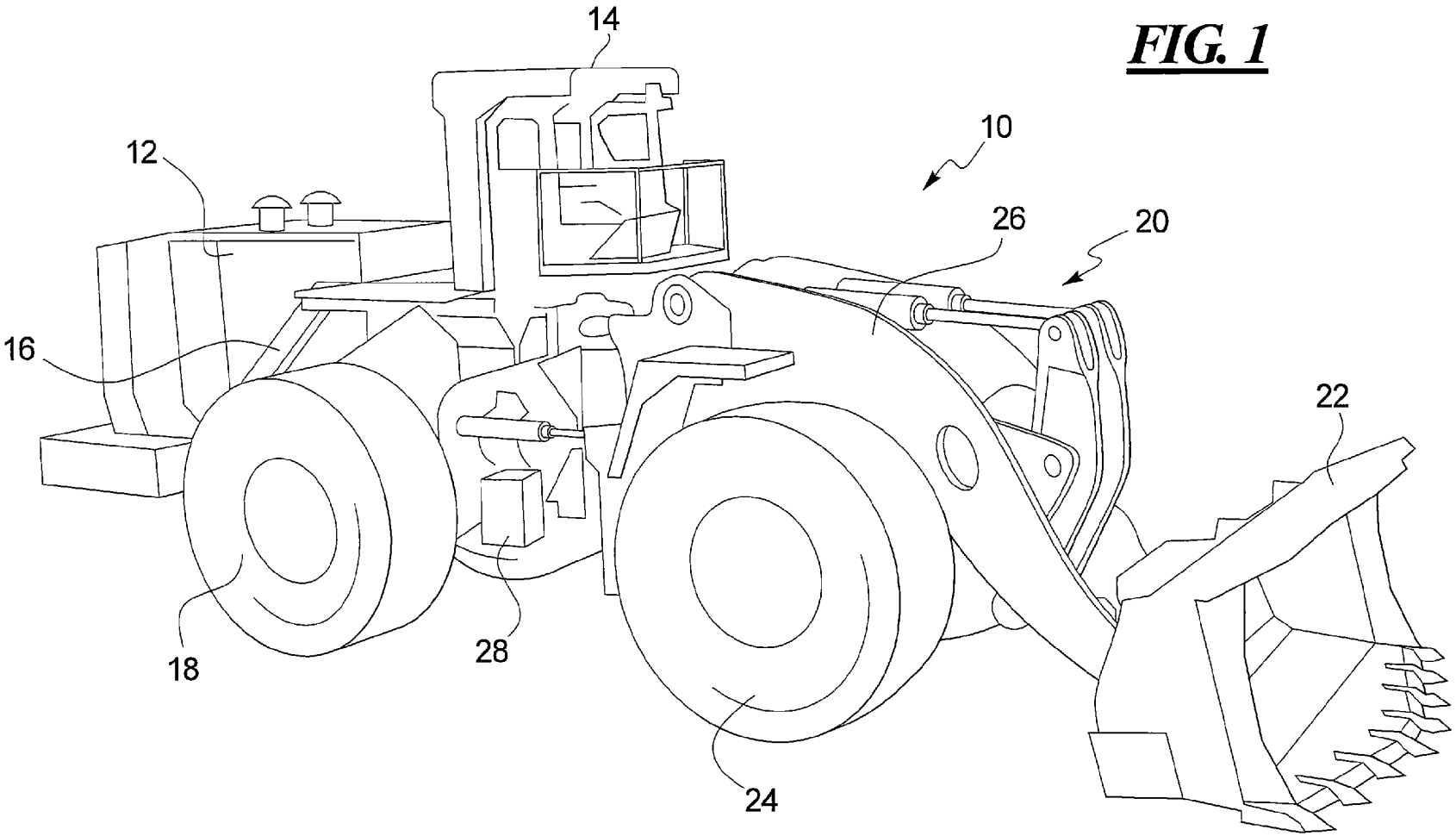
FIG. 1 is a perspective view of a large piece of earth moving equipment incorporating a fluid level monitoring system in accordance with the present disclosure.

Referring to FIG. 1, a large earth moving machine 10, such as a large wheel loader having a 30 cubic yard bucket capacity, is depicted. The machine 10 has a vehicle body 12 having an operator cab 14 disposed on top of the body 12 to provide the operator with maximum visibility of the work area in front of the machine 10. The operator cab 14 is disposed high above ground level, and one or more stairways 16 are provided to give the operator access to the cab 14. Rear tires 18 of the machine 10 are mounted on a drive axle of the vehicle body 12 and driven by the engine of the machine 10. At the front of the vehicle body 12 is attached a forward frame 20 for operation of an implement 22, such as the illustrated bucket. The front tires 24 of the machine 10 are connected to the frame 20, and the forward frame 20 is articulated and moves from side-to-side under the control of the steering system to steer the machine 10 during operation. The forward frame 20 includes a linkage 26 for manipulation of the implement 22 by lifting the implement 22 and tilting the implement 22 up and down as necessary to scoop up a load of earth and dump the load into a dump truck. The linkage 26 includes multiple links, arms and levers, and lift and tilt cylinders operating under the control of the operator and an implement electronic control module (ECM) (not shown). Those skilled in the art will understand that other types of implements 22 may be attached at the forward frame 20 of the machine 10 instead of the bucket and manipulated to perform other operations, and the use of such alternative implements is contemplated by the inventors.

The operator cab 14 includes instruments allowing the operator to monitor the levels of the various fluids used in the machine 10. Fuel, oil and coolant for the engine may be monitored, as well as oil in the transmission and grease in the automatic lubrication system, oil for the steering and implement, and windshield washer fluid. To facilitate maintenance of the large machine 10, a fluid level monitoring system 28 may be located at ground level that will allow monitoring of the fluid level and other operating conditions of the machine 10 without the necessity of climbing the stairway 16 up to the cab 14. The fluid level monitoring system 28 may be located between the tires 18, 24 on one side of the vehicle body 12, or at any other location with convenient access for maintenance operations.

Figure 2:
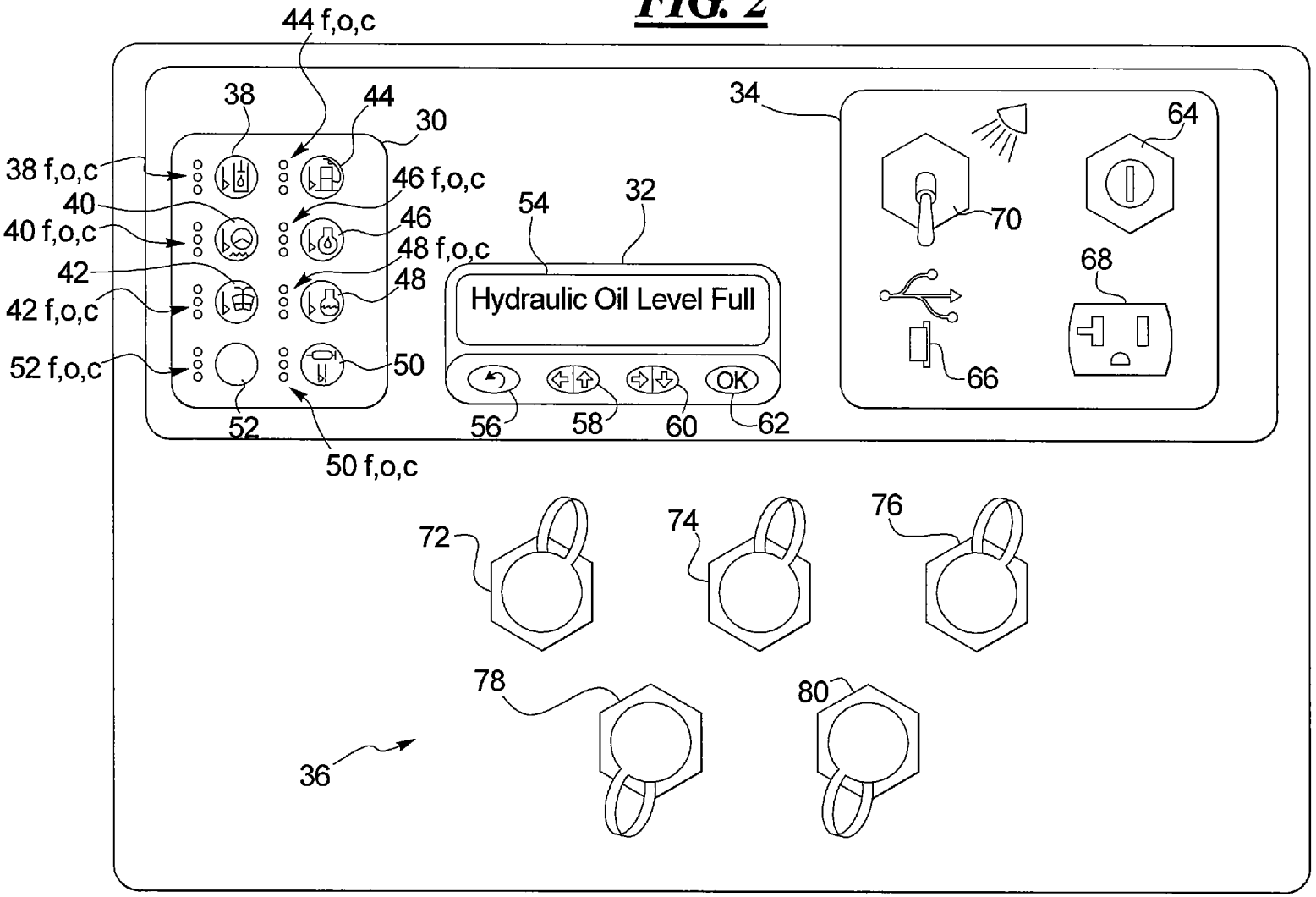
FIG. 2 is a front elevational view of a front panel of an embodiment of a fluid level monitoring system in accordance with the present disclosure.

One embodiment of a fluid level monitoring system 28 is illustrated in FIG. 2. The fluid level monitoring system 28 may include a control panel 30, a message display device 32 having a graphical display, a service tool connector area 34 and a fluid port area 36. The control panel 30 may provide the primary fluid monitoring display for each of the fluids used in the machine 10. In one embodiment, the control panel 30 may include a push button for each monitored fluid including a pictograph indicative of the monitored fluid. In the present embodiment, the control panel 30 may include an implement hydraulic oil button 38, a steering oil button 40, a windshield washer fluid button 42, a fuel button 44, an engine oil button 46, an engine coolant button 48 and an auto-lubricant button 50. As shown, the control panel 30 may include one or more extra buttons 52 in the event that other fluids require monitoring. Each of the buttons 38-50 may be backlit to provide visibility where no other light is available. Moreover, each of the buttons 38-50 may have a corresponding switch that is actuated when the button 38-50 is depressed to cause a display to be provided at the message display device 32 as will be discussed more fully below.

Along with each button 38-52, a plurality of indicators may be provided. The indicators may be light emitting diodes (LEDs) or other appropriate lighting device. The topmost indicators **38*f*-52*f* may be FULL status indicators, the middle indicators 38*o*-52*o* may be OK status indicators, and the bottommost indicators 38*c*-52*c* may be CHECK status indicators. All three indicators for a given button, e.g., indicators 38*f*, 38*o*, 38*c* for hydraulic oil button 38, may be illuminated when the monitored fluid is at or above a full level. The lower two indicators for a given button, e.g., 40*o*, 40*c* for the steering oil button 40, may be illuminated when the monitored fluid is below the full level and above a check or refill level. The lowest indicator for a given button, e.g., 48*c* for the engine coolant button 48**, may be illuminated when the monitored fluid reaches the point at which the fluid must be refilled or replaced. The strategy for determining the status of a monitored fluid and the corresponding indicator lamps to be illuminated will be discussed further herein below.

While the control panel 30 in the illustrated embodiment is implemented with push buttons and LED indicators, other embodiments of control panels providing the functionality of the present disclosure are contemplated by the inventors and will be apparent to those skilled in the art. For example, instead of three indicators per monitored fluid, a single multi-color indicator, such as a multi-color LED, may be used with each of the push buttons. The multi-color indicators may illuminate green when the monitored fluid is above the full level, yellow when the fluid is below the full level but above the refill level, and red when the fluid is below the refill level.

Further, instead of push buttons, the control panel 30 may be implemented with other types of input devices, such as rocker switches, the actuation of which may be detected and cause the display of a message for the corresponding monitored fluid at the message display device 32 as discussed further below. Still further, the control panel 30 may be implemented using a touch screen displaying pictographs and providing graphical indications of the fluid level status for each of the monitored fluids. The touch screen may respond when touched in the area of a pictograph as if a button was pressed or other switch was actuated to cause messages to be displayed at the message display device 32. Of course, the control panel 30 may be any other combination of display device (s) and physical switches, and other control panel configurations providing displays identifying each fluid being monitored by the fluid level monitoring system 28 and indicating fluid level statuses of the monitored fluids, and providing input devices allowing maintenance technicians or other users to select monitored fluids for the display of further messages related to the fluids are contemplated by the inventors as having use in fluid level monitoring systems 28 in accordance with the present disclosure.

The message display device 32 may provide messages for the maintenance technicians corresponding to the statuses indicated by the buttons 38-52 and corresponding indicators **38*f*-52*f*, 38*o*-52*o*, 38*c*-52*c*. The message display device 32 may include a display screen 54, such as a liquid crystal display (LCD) screen or other type of illuminated display. To control the information shown on the display screen 54, the message display device 32 may include a plurality of control buttons. The control buttons may include a return button 56 that restores the message at the display screen 54 to the previous message, a left/up button 58 for scrolling the message to the left or upwardly to the previous portion of the message, a right/down button 60 for scrolling the message to the right or downwardly to the subsequent portion of the message, and an enter button 62 for confirming or clearing the currently displayed message from the display screen 54. As with the control panel 30, alternative configurations of the message display device 32 are contemplated by the inventors that provide graphical display and screen navigation functionality, such as touch screens integrating the display screen 54 and buttons 56-62. The operation of the message display device 32 in conjunction with the control panel 30 and the various ECMs of the machine 10** will be discussed more fully below.

The service tool connector area 34 may provide necessary controls and connectivity ports for the maintenance personnel to operate the fluid level monitoring system 28 and extract necessary information for maintenance of the machine 10. To ensure that only authorized and trained personnel are able to access the fluid level monitoring system 28, access to the information and operation of the fluid level monitoring system 28 may be controlled at a key operated on/off switch 64. Due to the sophistication of the machine 10 and the onboard information systems (OIS) implemented therein, maintenance procedures may require extraction of information from various ECMs of the machine 10 and the performance of diagnostics on the OIS. To facilitate the acquisition of the information and interfacing with the OIS, the connector area 34 may include a connector port 66 to which a laptop or other intelligent device may be connected. The illustrated embodiment show a connector port 66 configured for connection of a universal serial bus (USB) cable, but the person skilled in the art will understand that other types of connections may be provided as an alternative to or in addition to the USB connection depending on the type of device being connected at the fluid level monitoring system 28. The connector area 34 may further include an appropriate power port 68 for connection of the power cord of the external intelligent device. Since adequate lighting cannot be ensured, the fluid level monitoring system 28 may have a flood lamp or surface mounted light(s) for light, with a corresponding light switch 70 being located at the connector area 34.

It may be possible to locate ports for several of the monitored fluids at the fluid level monitoring system 28 for quickly and conveniently adding fluid when necessary. Consequently, the fluid port area 36 of the fluid level monitoring system 28 may include an implement hydraulics fill port 72, a steering oil fill port 74, an engine oil fill port 76, an engine coolant fill port 78, and a transmission fluid fill port 80. It may be required to locate ports for the fuel tank and windshield washer fluid reservoir at those locations instead of at the fluid level monitoring system 28. The fill ports 72-80 may have appropriate couplings for attaching fluid lines from the replenishment fluid reservoirs or pumps. If desired, internal pumps may be provided for the fill ports 72-80 to draw the corresponding fluids into their respective reservoirs within the machine 10. Though not illustrated herein, the fluid level monitoring system 28 may further be provided with drain ports where appropriate to drain and collect used fluids such as the various oils used in the machine 10 for appropriate ecologically safe disposal.

Figure 3:
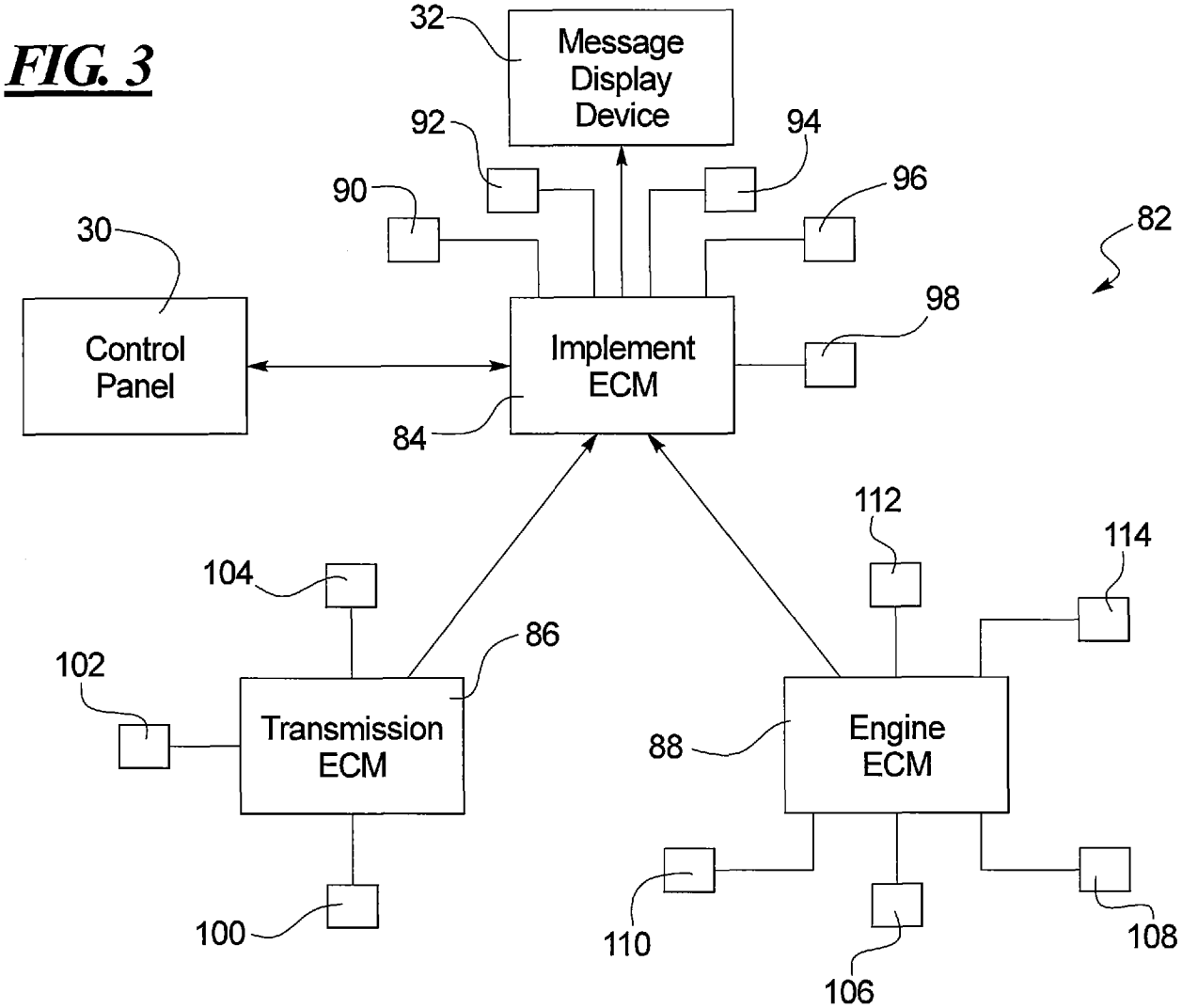
FIG. 3 is a schematic view of the electrical components of the fluid level monitoring system of FIG. 2 and a corresponding portion of an onboard information system (OIS)

For the control panel 30 and message display device 32 of the fluid level monitoring system 28 to display accurate fluid monitoring information, the components are operatively connected to the OIS of the machine 10. FIG. 3 shows a schematic illustration of an embodiment of a fluid monitoring portion 82 of the OIS of the machine 10 configured to determine the levels of the various fluids in the machine 10. Control of the various components of the machine 10 may be distributed over several ECMs, and the monitoring portion 82 of the OIS may include an implement ECM 84, a transmission ECM 86 and an engine ECM 88. Each of the ECMs 84-88 may control the operation of the corresponding component, and may also receive information regarding the levels of the fluids in the controlled components from corresponding fluid level sensors. Consequently, the implement ECM 84 may receive fluid level information from a steering oil level add sensor 90, a steering oil level full sensor 92, an implement oil level add sensor 94, an implement oil level full sensor 96, and a windshield washer fluid level low sensor 98. The transmission ECM 86 may receive fluid level information from a transmission oil level low sensor 100, a continuous fuel level sensor 102 and a continuous auto-lube grease level sensor 104. Finally, the engine ECM 88 may receive fluid level information from engine oil level add sensors 106, 108, an engine oil level full sensor 110, an engine coolant level add sensor 112, and an engine coolant level full sensor 114. Two engine oil level add sensors 106, 108 may be provided to take different measurements of the engine oil level depending on whether the engine is running or not as will be discussed more fully below. As illustrated, the implement ECM 84 may function as the centralized fluid monitoring element. As such, the implement ECM 84 may receive information from the transmission ECM 86 and the engine ECM 88, and may provide monitoring information to the control panel 30 and the message display device 32 for providing accurate fluid monitoring information at the fluid level monitoring system 28 for the maintenance technicians. Moreover, the implement ECM 84 may detect the actuation of switches of the control panel 30 when the corresponding buttons 38-50 are depressed, and cause the message display device 32 to display messages at the display screen 54 based on the statuses of the monitored fluids. Of course, those skilled in the art will understand that any of the ECMs 84-88 or other ECMs implemented in the machine 10 could perform the monitoring functions described herein, or additional intelligence and communication links could be provided at the message display device 32, and such implementations are contemplated by the inventors as having use with fluid level monitoring systems 28 in accordance with the present disclosure.

Figure 4:
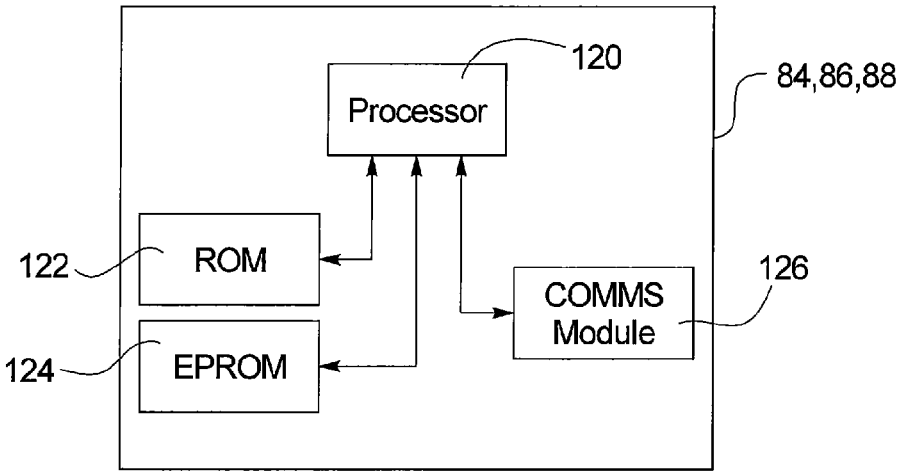
FIG. 4 is a schematic view of the electrical components of an exemplary electronic control module (ECM)

FIG. 4 schematically illustrates the components of the ECMs 84-88 that may perform the processing and communications required for the ECMs 84-88. Each ECM 84-88 may include a processor 120, read only memory (ROM) 122, erasable programmable read only memory (EPROM) 124 and a communications module 126, with all the components being interconnected to perform the processing described herein. The processor 120 may be any appropriate processing device capable of executing program instructions stored in ROM 122 and EPROM 124, reading data from and writing data to EPROM 124, detecting actuation of the buttons 38-52, 56-63 of the control panel 30 and message display device 32, respectively, outputting signals causing the lamps **38*f*-52*f*, 38*o*52*o*, 38*c*-52*c* and display screen 54 to operate, and to communicate with the other ECMs 84-88 and external devices connected to the fluid level monitoring system 28 at connector port 66 or other connectivity ports provided in the fluid level monitoring system 28. ROM 122 and EPROM 124 may be any appropriate permanent and erasable non-volatile memories, respectively, capable of storing the software necessary to provide the functionality of the ECM and the fluid level monitoring system 28 discussed herein. The communications module 126 may encompass the hardware and software necessary for performing communications with the control panel 30, with the message display device 32, with the other ECMs 84-88, and with additional external devices. Consequently, the communications module 126 may be configured with direct connections to the control panel 30, the message display device 32, and the other ECMs 84-88, and/or for performing wireless communications with any or all of the devices as well as external devices. Moreover, the communications module 126 may include additional external interface ports in addition to the connector port 66 to which external devices may be directly connected to the fluid level monitoring system 28 for the exchange of information. Those skilled in the art will understand that the combination of electrical components illustrated and described herein is merely exemplary, and other combinations of electrical components capable of providing the functionality set forth herein are contemplated by the inventors as having use in fluid level monitoring systems 28** in accordance with the present disclosure.

Figure 5:
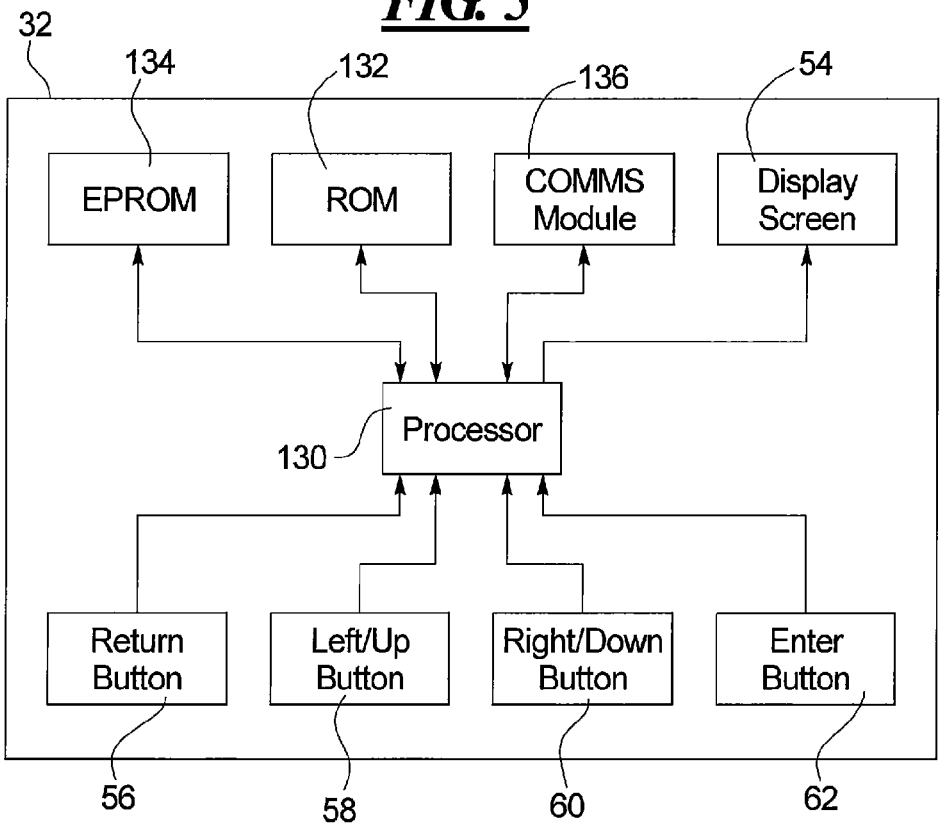
FIG. 5 is a schematic view of the electrical components of a message display device of the fluid level monitoring system of FIG. 2 in accordance with the present disclosure.

The message display device 32 may also be provided with a level of intelligence associated with receiving and displaying messages from an ECM 84-88, and changing the display in response to commands input at the buttons 56-62. FIG. 5 schematically illustrates the electrical components of the message display device 32 that may perform the processing and communications required for the message display device 32. The message display device 32 may include a processor 130, read only memory (ROM) 132, erasable programmable read only memory (EPROM) 134 and a communications module 136, with all the components being interconnected to perform the processing described herein. As with the processor 120 described above, the processor 130 may be any appropriate processing device capable of executing program instructions stored in ROM 132 and EPROM 134, reading data from and writing data to EPROM 134, detecting actuation of the buttons 56-62 and message display device 32, outputting signals causing the display screen 54 to display messages received from the implement ECM 84, and otherwise communicating with the implement ECM 84 as necessary for the display of the fluid monitoring messages. ROM 132 and EPROM 134 may be any appropriate permanent and erasable non-volatile memories, respectively, capable of storing the software necessary to provide the functionality of the message display device 32 discussed herein. The communications module 136 may encompass the hardware and software necessary for performing communications with the implement ECM 84. Consequently, the communications module 136 may be configured with direct connections to the implement ECM 84, or for performing wireless communications with the implement ECM 84. Those skilled in the art will understand that the combination of electrical components illustrated and described herein is merely exemplary, and other combinations of electrical components capable of providing the functionality set forth herein are contemplated by the inventors as having use in message display devices 32 in accordance with the present disclosure.

In the present embodiment, the ECMs 84-88 determine the levels of the various fluids based on the signals from the sensors 90-114 and associated logic programmed into the ECMs 84-88. Based on these determinations, the implement ECM 84 in turn will cause the corresponding FULL (**38*f*-52*f*), OK (38*o*-52*o*) and CHECK (38*c*-52*c*) status indicators of the control panel 30 to be illuminated in combinations corresponding to the statuses of the monitored fluid levels. With the fill status of the fluids established, information for the various monitored fluids may be displayed at the display screen 54 of the message display device 32. For a given fluid, pressing the corresponding button 38-52 triggers an associated switch. The processor 120 of the implement ECM 84 may detect the actuation of the switch and retrieve the status of the corresponding fluid stored in the EPROM 124. Depending on the status of the fluid level, the processor 120 may retrieve a corresponding status message from the ROM 122 or EPROM 124. The retrieved status message may then be transmitted to the message display device 32 for display at the display screen 54**.

Figure 6:
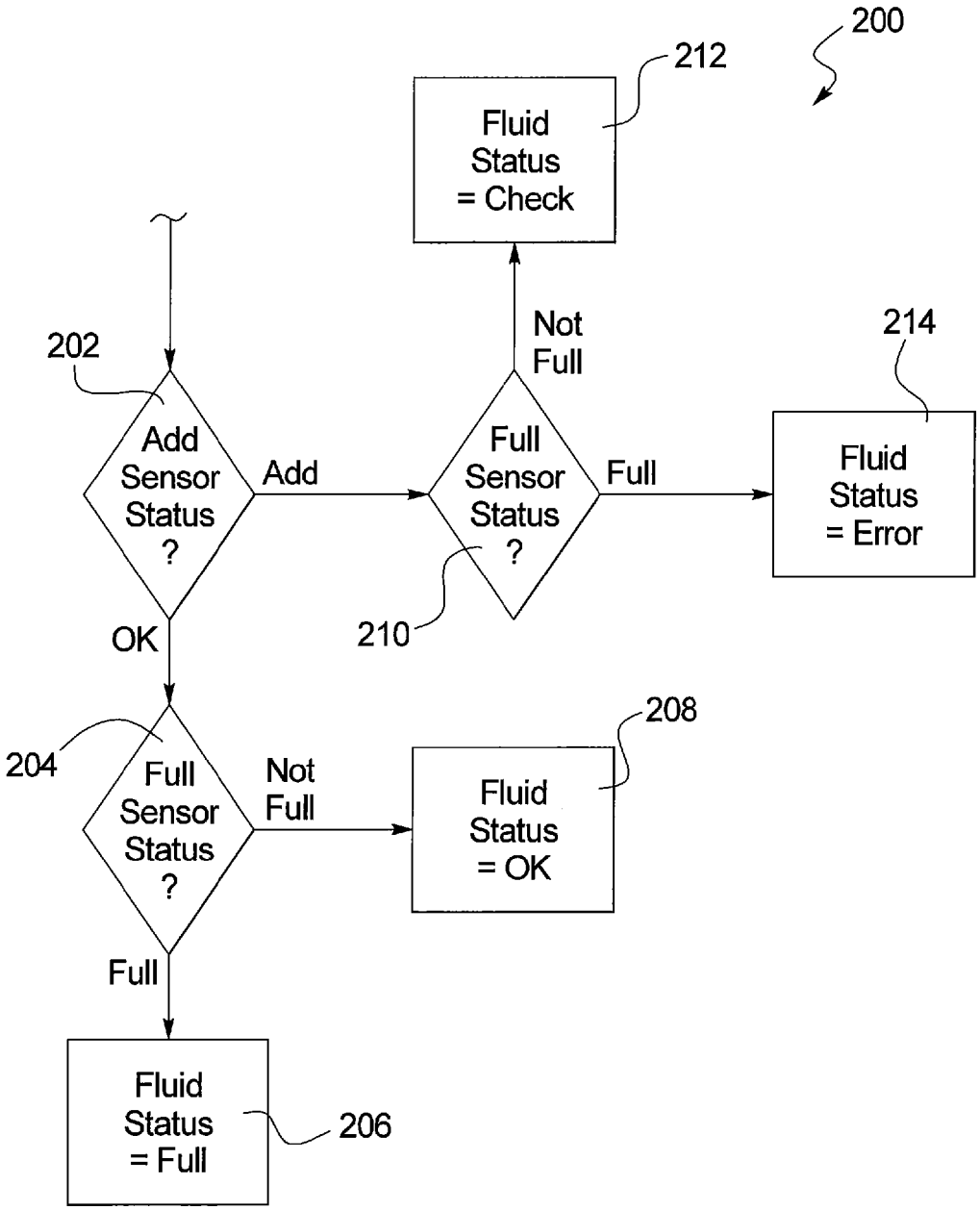
FIG. 6 is a flow diagram of a fluid level monitoring routine evaluating the status of two sensors monitoring the level of a fluid.

Various strategies for determining the level or status of a monitored fluid may be implemented depending on the fluid being monitored, the precision required, and the potential damage that may be caused to the machine 10 if the fluid level is too low and is not replenished in a timely manner. FIG. 6 illustrates one embodiment of a fluid level monitoring routine 200 wherein both a fluid level add sensor and a fluid level full sensor are used to monitor the level of the fluid. In the present embodiment, one such routine may be implemented at the implement ECM 84 for monitoring the levels of the hydraulic oil and steering oil, and/or at the engine ECM 88 for the engine coolant. Each sensor may have a switch that may be actuated to a first value where the fluid is above a predetermined level and a second value where the fluid is below the predetermined level. Using the engine coolant fluid as an example, the fluid level monitoring routine 200 at the engine ECM 88 may begin at a block 202 wherein the status of the engine coolant level add sensor 112 is evaluated. If the status of the engine coolant level add sensor 112 indicates that the engine coolant is above the predetermined add level, engine coolant does not need to be added and control passes to a block 204. At block 204, the status of the engine coolant level full sensor 114 is evaluated. If the status of the sensor 114 indicates that the engine coolant is above a predetermined full level, control passes to a block 206 wherein the engine ECM 88 sets a status of the engine coolant to a value indicating that the reservoir is full and transmits the status to the implement ECM 84. In response to receiving the status from the engine ECM 88, the implement ECM 84 transmits signals to the control panel 30 causing the indicators 48*f*, 48*o*, 48*c* to be illuminated to indicate that the engine coolant is full. If the status of the sensor 114 indicates that the engine coolant is below the full level at block 204, control passes to a block 208 wherein the engine ECM 88 sets a status of the engine coolant to a value indicating that the reservoir is not full but does not need to be checked. The engine ECM 88 then transmits the status to the implement ECM 84, which in turn transmits signals to the control panel 30 causing the indicators 48*o*, 48*c* to be illuminated to indicate that the engine coolant is at an acceptable but less than full level.

If at block 202 the status of the engine coolant level add sensor 112 indicates that the engine coolant is below the predetermined add level, engine coolant may need to be added to the coolant reservoir and control passes to a block 210. At block 210, the status of the engine coolant level full sensor 114 is evaluated to determine if the value at the sensor 114 is consistent with the need to replenish the engine coolant indicated by the sensor 112. If the status of the sensor 114 indicates that the engine coolant is below the full level at block 210, the values of the sensors 112, 114 are consistent and control passes to a block 212 wherein the engine ECM 88 sets a status of the engine coolant to a value indicating that the reservoir needs to be checked and refilled. The engine ECM 88 then transmits the status to the implement ECM 84, which in turn transmits signals to the control panel 30 causing the indicator 48*c* to be illuminated and/or flash to indicate that the engine coolant needs to be checked. If the status of the sensor 114 indicates that the engine coolant is above a predetermined full level, then the values of the sensors 112, 114 are inconsistent in that the sensor 112 indicates that the engine coolant must be refilled and the engine coolant level full sensor 114 indicates that the engine coolant reservoir is full. In this situation, control passes to a block 214 wherein the engine ECM 88 may set the status of the engine coolant to a value indicating that the reservoir needs to be checked and refilled, and may also set an engine coolant sensor status indicator to a value indicating that the sensors 112, 114 have conflicting values. The engine ECM 88 may then transmit the status of the engine coolant reservoir and the sensor status indicator to the implement ECM 84. In response to receiving the statuses from the engine ECM 88, the implement ECM 84 transmits signals to the control panel 30 causing the indicators 48*f*, 48*o*, 48*c* to flash to indicate that a problem may exist with the sensors 112, 114, and stores the value of the sensor status indicator for use in determining a message to send to the message display device 32 as will be discussed more fully below. The logic of monitoring routine 200 may be implemented at the implement ECM 84 for monitoring the levels of the steering oil and implement oil in the manner described above, but without the necessity of transferring information between the ECMs 84, 88.

Figure 7:
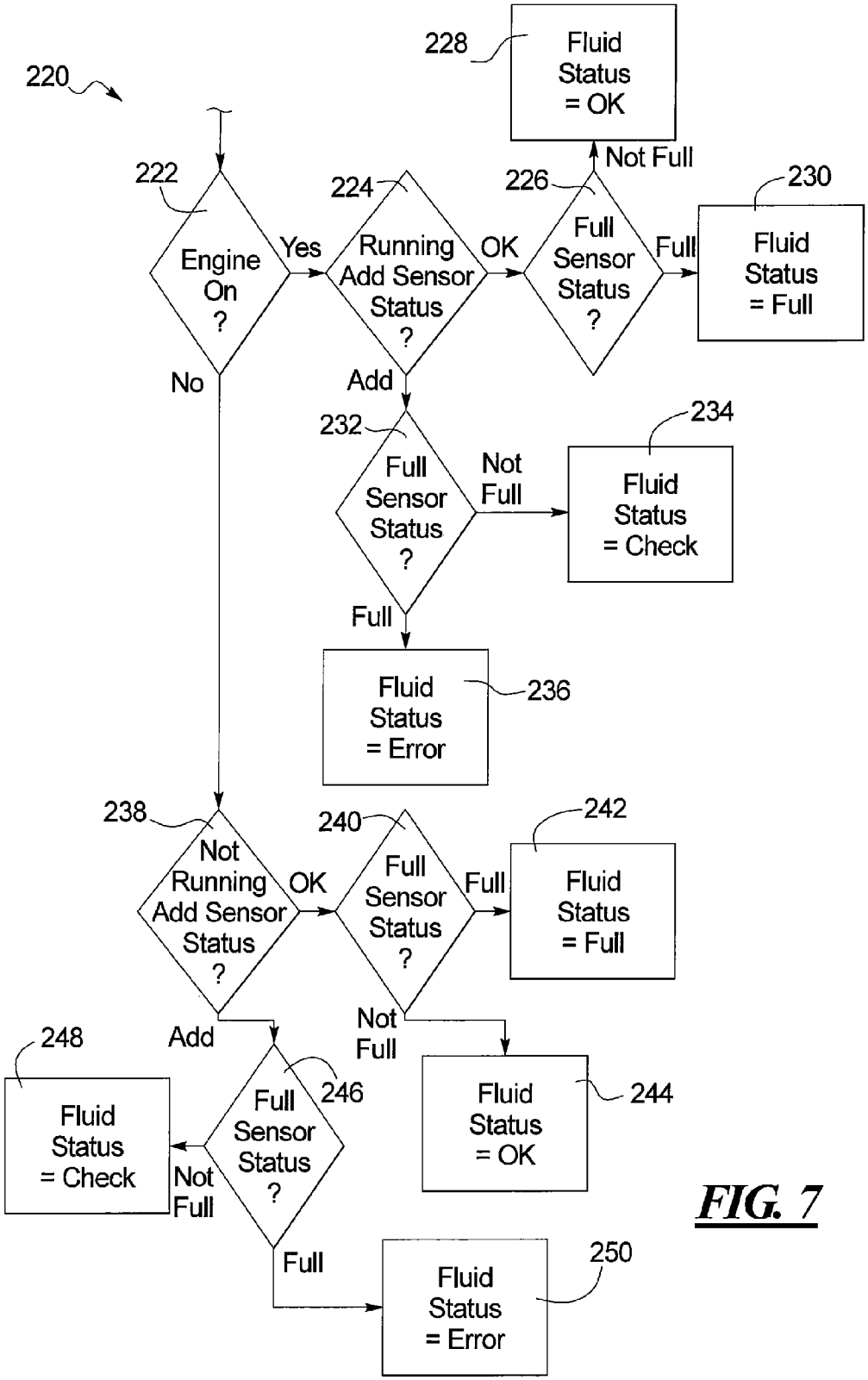
FIG. 7 is a flow diagram of a fluid level monitoring routine evaluating the status of three sensors monitoring the level of a fluid.

Other monitoring routines may be implemented based on the monitoring needs for a particular fluid. For example, it may be necessary or desired to evaluate the engine oil differently when the engine is running than when the engine is sitting idle. The level at which the engine oil must be replenished may be different when the engine is running than when the engine is not running or idling, and therefore the need exists for the engine oil level add sensor 106 to provide a status of the engine oil at the add level for the non-running engine and the engine oil level add sensor 108 to provide a status of the engine oil at the add level for the running engine. To provide accurate information at the control panel 30 and message display device 32 for both the running and non-running engine conditions, a fluid level monitoring routine 220 as shown in FIG. 7 may be implemented at the engine ECM 88 and implement ECM 84. The monitoring routine 220 may start at a block 222 wherein the status of the engine is checked to determine whether the engine is running or not. Various methods may be used to evaluate the status of the engine. In one implementation, the engine speed may be evaluated such that the engine is considered to be not running at low engine speeds, such as when idling at speeds below 400 RPM, and running at higher engine speeds. If the engine is determined to be running at block 222, e.g., operating at more than 400 RPM, control passes to a block 224 to evaluate the status of the running engine oil level add sensor 106. If the status of the sensor 106 indicates that the engine oil is above a predetermined add level for the running engine, engine oil does not need to be added and control passes to a block 226. The block 226 may perform similar logic as block 204 of fluid level monitoring routine 200 and evaluate the status of the engine oil level full sensor 110. If the status of the sensor 110 indicates that the engine oil is below a predetermined full level, control passes to a block 228 wherein the engine ECM 88 sets a status of the engine oil to a value indicating that the reservoir is not full but does not need to be checked, and transmits the status to the implement ECM 84. In response to receiving the status from the engine ECM 88, the implement ECM 84 may store the engine oil level status and transmits signals to the control panel 30 causing the indicators 46*o*, 46*c* to be illuminated to indicate that the engine oil is at an acceptable but less than full level. If the status of the sensor 110 indicates that the engine oil is above a predetermined full level, control passes to a block 230 wherein the engine ECM 88 sets a status of the engine oil to a value indicating that the reservoir is full and transmits the status to the implement ECM 84. In response to receiving the status from the engine ECM 88, the implement ECM 84 may store the status and transmits signals to the control panel 30 causing the indicators 46*f*, 46*o*, 46*c* to be illuminated to indicate that the engine oil is full.

If the status of the sensor 106 indicates that the engine oil is below the predetermined add level for the running engine at block 224, control passes to a block 232 to perform similar logic as block 210 of the routine 200 and evaluate the status of the engine oil level full sensor 110 wherein the engine ECM 88 sets a status of the engine oil to a value indicating that engine oil must be added to the reservoir. The engine ECM 88 then transmits the status to the implement ECM 84, which in turn transmits signals to the control panel 30 causing only the indicator 46*c* to be illuminated to indicate that the engine oil must be replenished. At block 232, the status of the engine oil level full sensor 110 is evaluated to determine if the value at the sensor 110 is consistent with the need to replenish the engine oil indicated by the sensor 106. If the status of the sensor 110 indicates that the engine oil is below the full level at block 232, the values of the sensors 106, 110 are consistent and control passes to a block 234 wherein the engine ECM 88 sets a status of the engine oil to a value indicating that the reservoir needs to be checked and refilled. The engine ECM 88 then transmits the status to the implement ECM 84, which in turn may store the status and transmits signals to the control panel 30 causing the indicator 46*c* to be illuminated and/or flash to indicate that the engine coolant needs to be checked. If the status of the sensor 110 indicates that the engine oil is above a predetermined full level, then the values of the sensors 106, 110 are inconsistent in a similar manner as discussed above for the sensors 112, 114. In this situation, control passes to a block 236 wherein the engine ECM 88 may set the status of the engine oil to a value indicating that the reservoir needs to be checked and refilled, and may also set an engine oil sensor status indicator to a value indicating that the sensors 106, 110 have conflicting values. The engine ECM 88 may then transmit the statuses to the implement ECM 84, and the implement ECM 84 may respond by transmitting signals to the control panel 30 causing the indicators 46*f*, 46*o*, 46*c* to flash to indicate that a problem may exist with the sensors 106, 110, and storing the values of the statuses for use in determining a message to send to the message display device 32 as will be discussed more fully below.

If the engine ECM 88 determines that the engine is not running or idling at block 222, e.g., operating at less than 400 RPM, control may pass to a block 238 wherein the status of the non-running engine oil level add sensor 108 may be evaluated. When the engine is not running, the logic of the fluid level monitoring routine 220 may be very similar to the logic of the monitoring routine 200 and the portion of the routine 220 executed through block 224 as detailed above. If the status of the non-running engine oil level add sensor 108 indicates that the engine oil is above the predetermined non-running add level, control passes to a block 240 wherein the status of the engine oil level full sensor 110 is evaluated. If the status of the sensor 110 indicates that the engine oil is above a predetermined full level, control passes to a block 242 wherein the engine ECM 88 sets the status of the engine oil to a value indicating that the reservoir is full and transmits the status to the implement ECM 84. In response, the implement ECM 84 transmits signals to the control panel 30 causing the indicators 46*f*, 46*o*, 46*c* to be illuminated to indicate that the engine oil is full. If the status of the sensor 110 indicates that the engine oil is below the full level at block 240, control passes to a block 244 wherein the engine ECM 88 sets a status of the engine oil to a value indicating that the reservoir is not full but does not need to be checked, and transmits the status to the implement ECM 84, which in turn transmits signals to the control panel 30 causing the indicators 46*o*, 46*c* to be illuminated to indicate that the engine oil is at an acceptable but less than full level.

If at block 238 the status of the sensor 108 indicates that the engine oil is below the predetermined add level, engine oil needs to be added to the reservoir and control passes to a block 246. At block 246, the status of the engine oil level full sensor 110 is evaluated to determine if the value at the sensor 110 is consistent with the need to replenish the engine oil indicated by the sensor 108. If the status of the sensor 110 indicates that the engine oil is below the full level at block 246, the values of the sensors 108, 110 are consistent and control passes to a block 248 wherein the engine ECM 88 sets a status of the engine oil to a value indicating that the reservoir needs to be checked and refilled. The engine ECM 88 then transmits the status to the implement ECM 84, which in turn transmits signals to the control panel 30 causing the indicator 46*c* to flash to indicate that the engine oil needs to be checked. If the status of the sensor 110 indicates that the engine oil is above a predetermined full level, then the values of the sensors 108, 110 are inconsistent, and control passes to a block 250 wherein the engine ECM 88 sets the status of the engine oil to a value indicating that the reservoir needs to be checked and refilled, and may also set an engine oil sensor status indicator to a value indicating that the sensors 108, 110 have conflicting values. The engine ECM 88 may then transmit the status and the value of the sensor status indicator to the implement ECM 84, which in turn transmits signals to the control panel 30 causing the indicators 46*f*, 46*o*, 46*c* to flash indicating the conflicting values of the sensor 108, 110, and stores the value of the sensor status indicator. Though the monitoring routine 220 is only implemented for the engine oil in the present example, similar monitoring strategies may be used for other fluids where the evaluation of the fluid level may be dependent on whether the engine or other component of the machine 10 is operational.

Other of the fluids may be monitored using less complex strategies and/or sensors and logic capable of distinguishing between the levels at which the fluid reservoir is full, requires replenishment, or is in between. For example, the fuel level sensor 102 and auto-lube grease level sensor 104 may be continuous fluid level sensors configured such that the sensors 102, 104 provide signals that vary with the level of the corresponding fluid, and the transmission ECM 86 may be programmed with a fluid level monitoring algorithm that interprets the signals to determine the level of the fluids. For the fuel level, the transmission ECM 86 may be programmed to detect whether the signal from the fuel level sensor 102 indicates a fuel level below a predetermined refill level, above a predetermined full level, or between the full and refill levels. Based on the detected fuel level, the transmission ECM 86 may transmit a corresponding fuel level status to the implement ECM 84 causing the implement ECM 84 to transmit signals to the control panel 30 to illuminate the indicator 44*c* when the fuel should be refilled, to illuminate the indicators 44*o*, 44*c* when the fuel level is acceptable, and to illuminate the indicators 44*f*, 44*o*, 44*c* when the fuel reservoir is full. Similar logic would be used for tracking the status and illuminating the indicators 50*f*, 50*o*, 50*c* for the auto lube grease. Logic may also be included that will set the fluid level status or a sensor status to an Error or Unknown value if a continuous fluid level sensor is faulted. In such a situation, the implement ECM 84 may transmit signals to the control panel 30 causing all three indicators for the corresponding fluid to flash.

In the case of the windshield washer fluid, less precision may be necessary as to the fluid level. Consequently, the implement ECM 84 may be programmed with a fluid level monitoring algorithm that evaluates the signal from the washer fluid level sensor 98 to determine whether the washer fluid is above or below a predetermined refill level. If the washer fluid is below the refill level, the implement ECM 84 may transmit signals to the control panel 30 to illuminate the indicator 42*c*. If the washer fluid is above the refill level, the implement ECM 84 may transmit signals to the control panel 30 to illuminate the indicators 42*o*, 42*c*.

INDUSTRIAL APPLICABILITY

The configuration of the fluid level monitoring system 28 and the fluid monitoring portion 82 of the OIS discussed above may facilitate the servicing of the large earth moving machine 10 by the maintenance technicians. While the machine 10 is running and/or when the switch 64 of the fluid level monitoring system 28 is turned on, the ECMs 84-88 may execute their monitoring routines to evaluate the signals from the various sensors 90-114, determine the status of each monitored fluid, and illuminate the appropriate indicators 38*f*-50*f*, 38*o*-50*o*, 38*c*-50*c*. The ECMs 84-88 may be configured to execute the monitoring routines at regular intervals so that the displayed status of the monitored fluids at the control panel 30 is constantly updated to provide the current statuses of the monitored fluids. While the statuses of the monitored fluids may be clearly displayed at the control panel 30, additional information may be helpful to allow the maintenance technicians to replenish the correct fluids with appropriate type of fluid and in the correct amount. For example, while the pictographs on the buttons 38-50 may be generally helpful in determining the corresponding monitored fluids, not every maintenance technician may be familiar with the meaning of each of the images. Additionally, a maintenance technician with limited experience servicing a particular machine 10 may be unfamiliar with the amount and type of fluid, such as a particular weight of oil, that may be required when the control panel 30 indicates that a monitored fluid needs to be checked.

To facilitate the maintenance operation, the message display device 32 is integrated into the fluid level monitoring system 28 to provide the necessary information to ensure that the machine 10 is properly serviced. As discussed above, each of the buttons 38-50 has a corresponding switch that is actuated when the button 38-50 is pressed. The buttons 38-50 may be pressed by the maintenance technicians whey they want additional information about the status of the monitored fluids. The actuation of the switches is detected at the implement ECM 84, which is configured to determine the monitored fluid to which the actuated switch corresponds. Upon detection of the actuation of a switch, the implement ECM 84 may retrieve the current fluid level status for the corresponding monitored fluid from the EPROM 124. The implement ECM 84 may be further programmed to store a table of messages in the ROM 122 and/or EPROM 124, with each message corresponding to a status of one of the monitored fluids. After retrieving the fluid level status in response to the actuation of a switch, the implement ECM 84 may look up the monitored fluid and fluid level status in the stored table and retrieve the corresponding message. The retrieved message may then be transmitted from the implement ECM 84 to the message display device 32, where the processor 130 of the message display device 32 will cause the message to be displayed at the display screen 54. As an alternative, the fluid level statuses may be stored at the implement ECM 84, while the table with the messages may be stored at the ROM 132 and/or EPROM 134 of the message display device 32. In such an embodiment, the implement ECM 84 may transmit the retrieved fluid level status to the message display device 32, with the processor 130 then retrieving the corresponding message from the stored table.

Figure 8:
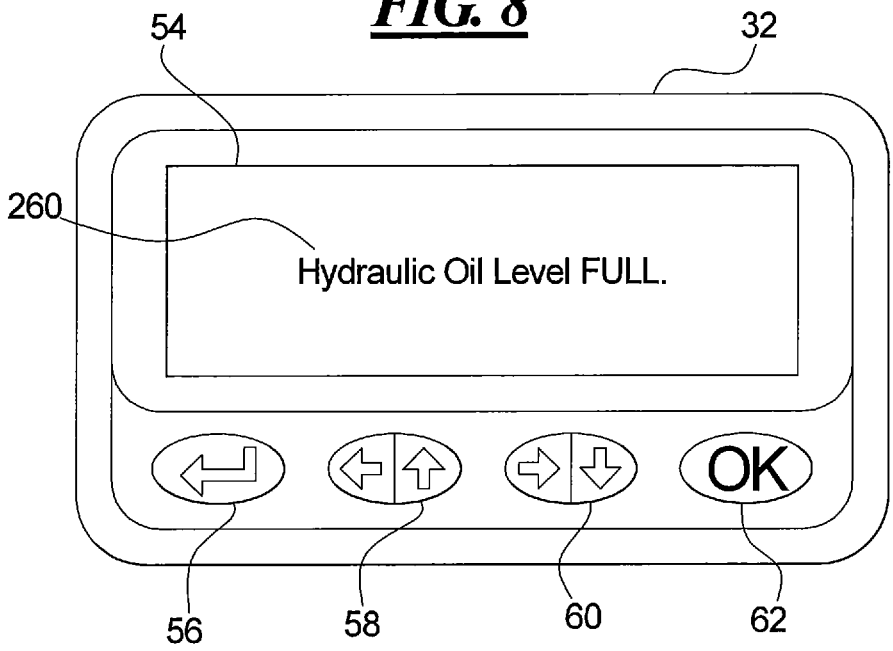
FIG. 8 is a front view of the message display device of the fluid level monitoring system of FIG. 2 displaying a fluid level full message.
Figure 9:
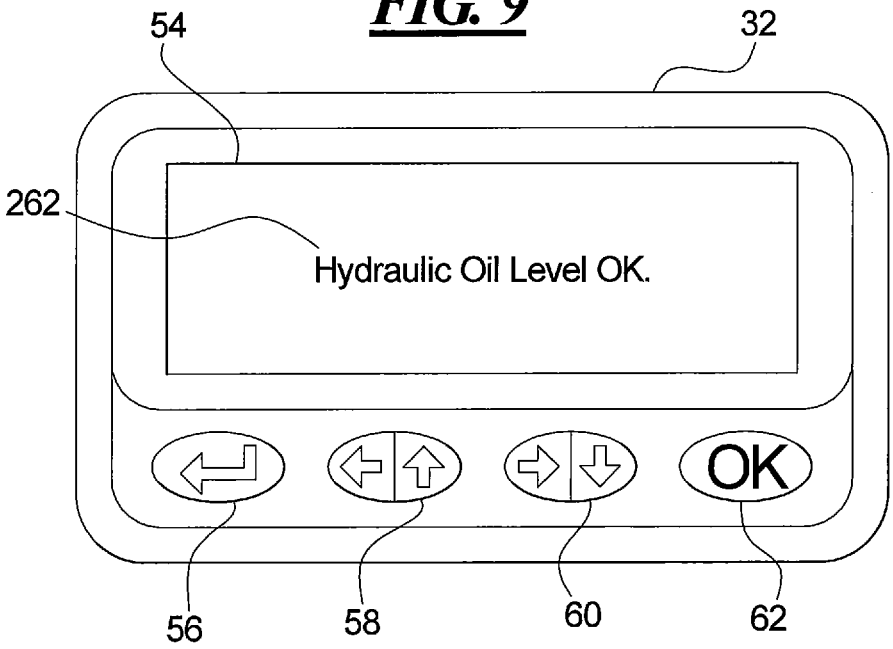
FIG. 9 is a front view of the message display device of the fluid level monitoring system of FIG. 2 displaying a fluid level OK message.
Figure 10:
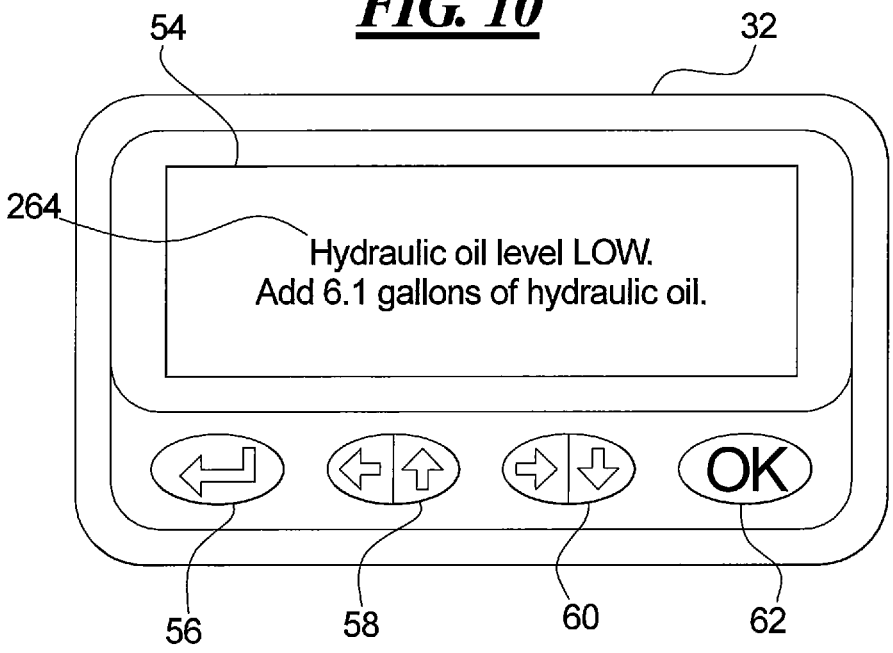
FIG. 10 is a front view of the message display device of the fluid level monitoring system of FIG. 2 displaying a fluid level low message.

The message display device 32 provides the manufacturer and/or owner of the machine 10 with a great deal of flexibility in the information that may be provided to the maintenance technicians about the monitored fluids. For some fluids, minimal information may be required when an acceptable amount of fluid is present in the reservoir. Consequently, when the indicators 38*f*, 38*o*, 38*c* are illuminated to indicate that the hydraulic oil level is full, pressing the hydraulic oil button 38 may cause the message display device 32 to display a simple hydraulic oil level full message 260 as shown in FIG. 8. Similarly, a hydraulic oil level OK message 262 as shown in FIG. 9 may be displayed at the display screen 54 if the hydraulic oil button 38 is pressed while the indicators 38*o*, 38*c* are illuminated in response to a determination that the fluid level is within the acceptable range but not full. Once the fluid reaches the level where it must be replenished, the messages to the maintenance technicians may be more informative to assist with quickly and properly refilling the fluid reservoir. For example, where only the indicator 38*c* is illuminated to indicate that the hydraulic fluid is low, pressing the hydraulic oil button 38 may cause the message display device to display the hydraulic oil level low message 264 shown in FIG. 10. The message 264 confirms that the hydraulic oil level is low, and informs the maintenance technician that 6.1 gallons of hydraulic oil must be added to replenish the fluid to the full level. The technician then knows how much hydraulic oil to add without having to look up the requirements in a separate manual. Knowing the amount of hydraulic oil to add, the technician may then attach an appropriate supply line to the implement hydraulics fill port 72 and add the appropriate amount of hydraulic oil to fill the reservoir. The amount of fluid in the message may be the actual amount of fluid to add to fill the reservoir where continuous fluid level sensors are used and the ECMs 84, 86, 88 are configured to determine the actual fluid level from the sensor signal and insert the fill amount into the message. Alternatively, the amount of liquid presented in the message may represent an approximate volume of fluid to add to fill the reservoir, such as the volume of fluid between the ADD level and the FULL level, or the between the ADD level and the top of the reservoir.

Figure 11:
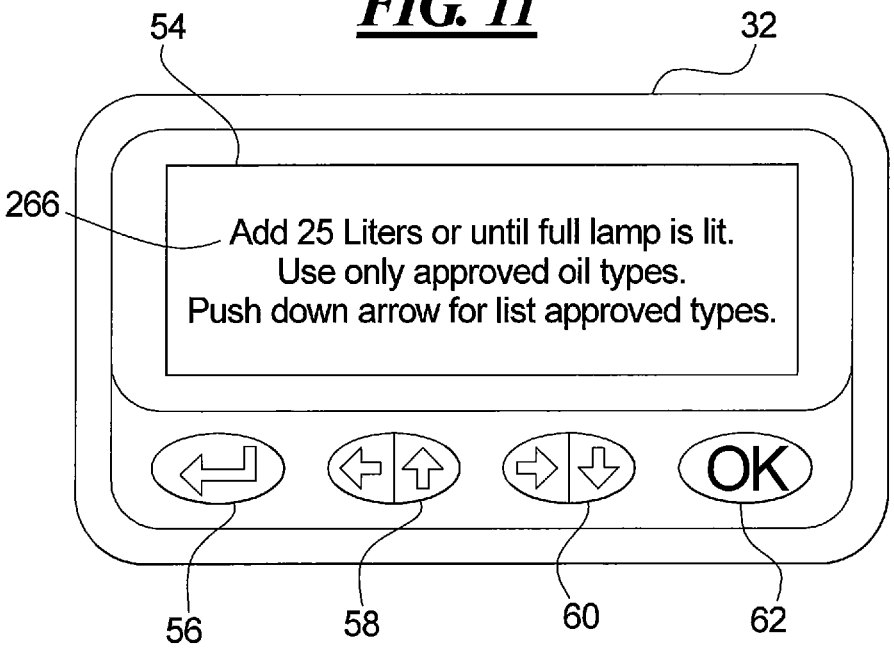
FIG. 11 is a front view of the message display device of the fluid level monitoring system of FIG. 2 displaying a fluid level low and approved fluids message.
Figure 12:
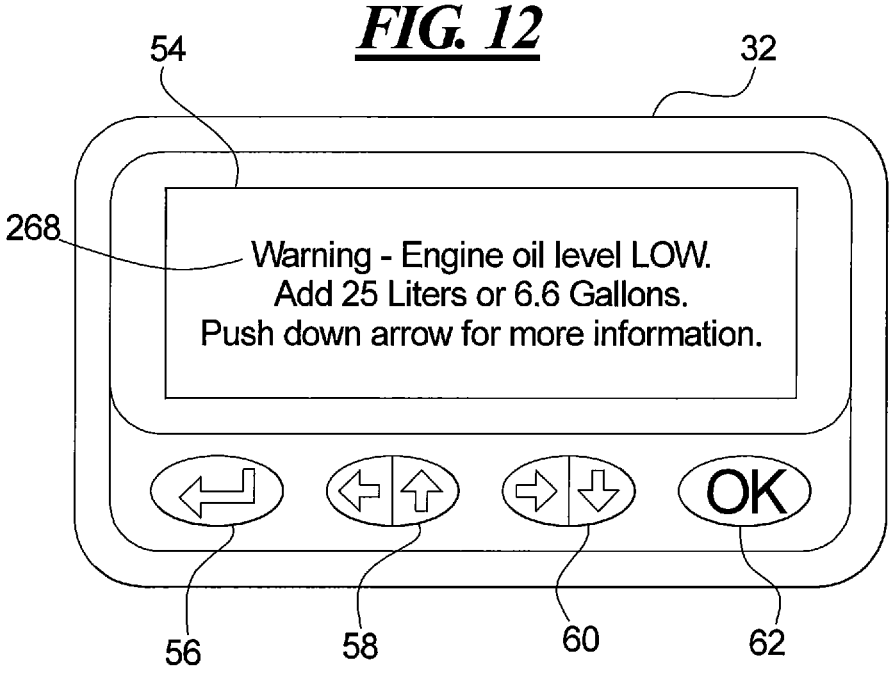
FIG. 12 is a front view of the message display device of the fluid level monitoring system of FIG. 2 displaying a multiple screen fluid level low message.

Depending on the fluid being replenished, additional information may be provided to the maintenance technicians when a fluid level is low. For example, particular types of fluids may be required for the equipment to function properly and to avoid damage while operating. For example, the engine may function optimally with a particular brand or weight of motor oil. In such cases, where the indicator 46*c* is illuminated to indicate that the engine oil must be refilled, an engine oil fill message 266 as shown in FIG. 11 may be displayed at the message display device 32 when the engine oil button 46 is pressed. The message 266 indicates the amount of oil to be added at the engine oil fill port 76, and warns the maintenance technician to use an approved oil type. To view the approved oil types, the maintenance technician may use the right/down button 60 to scroll down through the message 266 to display additional screens on the display screen 54. An alternate form of an engine oil fill message 268 is shown in FIG. 12, and may contain information for the maintenance technician in addition to the amount of oil to add and the approved types of oil, such as other maintenance checks to perform on the engine to ensure that the engine is operating properly.

Figure 13:
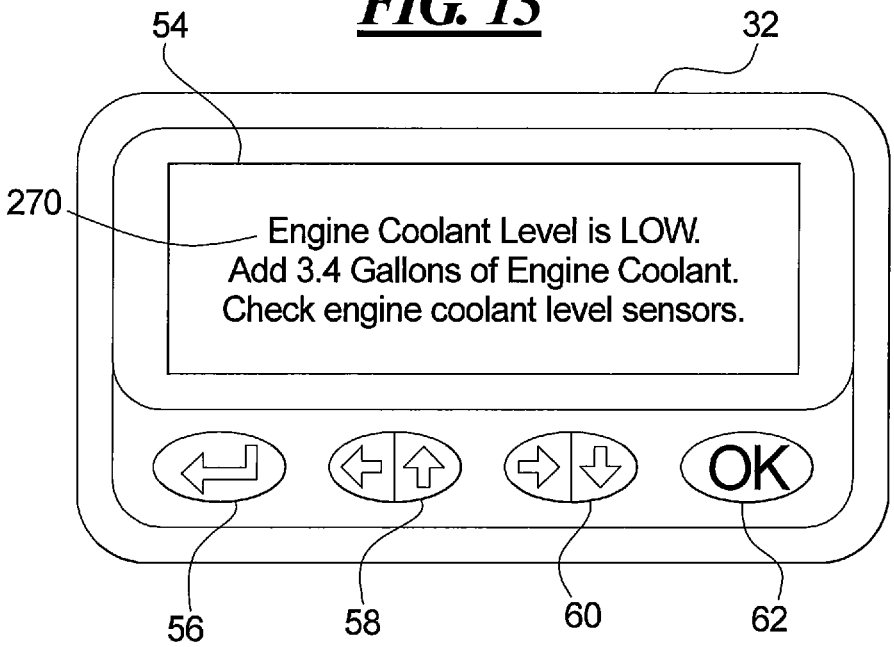
FIG. 13 is a front view of the message display device of the fluid level monitoring system of FIG. 2 displaying a fluid level low and check sensors message.
Figure 14:
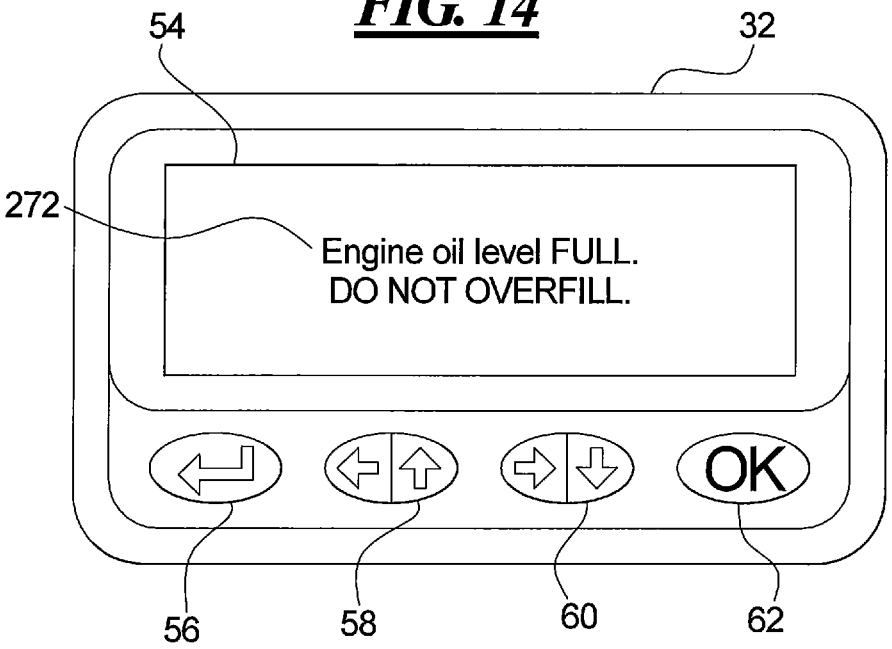
FIG. 14 is a front view of the message display device of the fluid level monitoring system of FIG. 2 displaying an alternate fluid level full message.

As mentioned above in the discussions of the monitoring routines 200, 220, the ECMs 84-88 may detect conditions wherein the fluid level sensors provide conflicting signals. As discussed with regard to the engine coolant, the engine coolant level add sensor 112 may provide a signal indicating that the engine coolant is below the refill level and must be replenished at the same time the engine coolant level full sensor 114 may provide a signal indicating that the engine coolant reservoir is full. In this situation, the block 214 may set an engine coolant sensor status indicator to a value indicating that the sensor conflict exists. The maintenance technicians may be alerted to the conflicting statuses via the message sent provided to the message display device 32. When the conflicting statuses exist for the engine coolant sensors 112, 114, only the indicator 48*c* may be illuminated to prompt the maintenance technicians to check the engine coolant. Upon actuation of the switch corresponding to the engine coolant button 48, the algorithm at the implement ECM 84 may cause the processor 120 to retrieve the engine coolant fluid level status and the sensor status indicator. After determining that the sensor status indicator is set to a sensor conflict value, the implement ECM 84 may transmit signals to the message display device 32 causing the message display device 32 to display an engine coolant level low and check sensors message 270 such as that shown in FIG. 13. In addition to prompting the technicians to check the sensors 112, 114, the message 270 may include further detailed information on subsequent screens, such as the conflicting signals causing the prompt for checking the sensors. If the engine coolant sensor status indicator is not set to the sensor conflict status value, a normal engine coolant level low message similar to the hydraulic oil level low message 264 may be displayed at the message display device 32. Additional information for the maintenance technicians may not be limited to the messages indicating that a particular fluid level is low. For example, an engine oil level full message 272 as shown in FIG. 14 may include a warning to the technicians regarding overfilling the engine oil. Other cautionary information may be provided in the messages displayed at the message display device 32.

Figure 15:
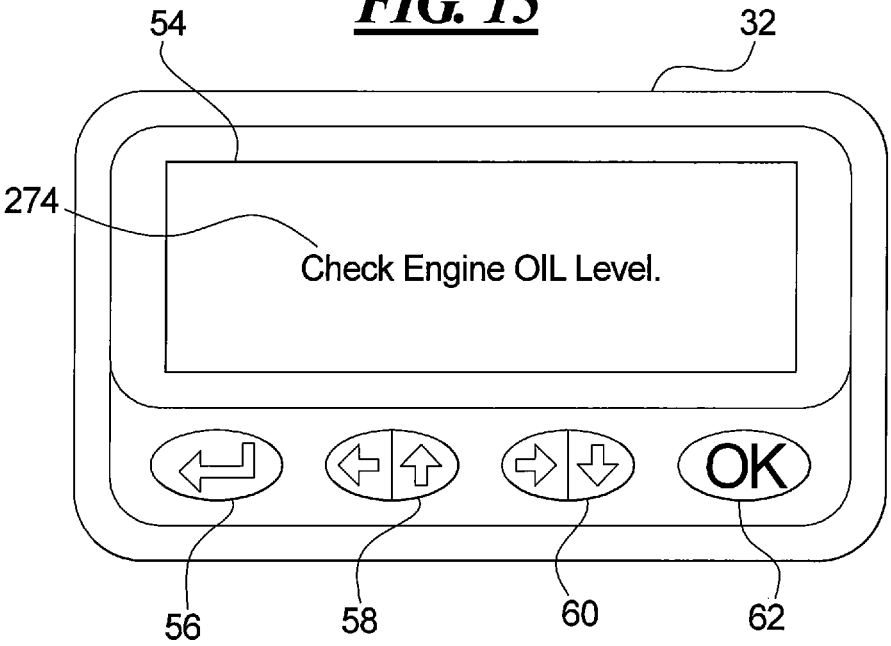
FIG. 15 is a front view of the message display device of the fluid level monitoring system of FIG. 2 displaying an alternate fluid level low message when button actuation is not detected.

In addition to displaying messages in response to the actuation of the switches of the control panel 30, the implement ECM 84 may be configured to display messages when the fluid level monitoring system 28 is operational but none of the buttons 38-50 have been pressed. In one embodiment, the implement ECM 84 may be configured to determine when a predetermined period of time elapses without the actuation of the control panel 30. After the time period elapses, the processor 120 of the implement ECM 84 may check the various fluid level statuses stored at the EPROM 124 to determine whether any of the monitored fluids has a check status. The order in which the fluid level statuses are checked may be dictated by a priority of the monitored fluids and the risk or severity of damage to the machine 10 if the fluid is not replenished in a timely manner. For example, it may be more critical to replenish the engine oil or implement oil than the windshield washer fluid, and the statuses of those fluids may be evaluated first. If the processor 120 determines that a fluid has a check status, then the processor 120 may transmit signals to the message display device 32 to display a check fluid level message such as the message 274 shown in FIG. 15. As long an none of the buttons 84-88 of the control panel 30 or the enter button 62 of the message display device 32 are pressed, the message display device 32 may continue to display the message 274 or highest priority message, or the processor 120 may cycle through the fluid level statuses and periodically cause the message display device 32 to display check fluid messages for other monitored fluids that have reached the replenishment level. When one of the buttons 38-50 is finally pressed to actuate the corresponding switch, the processor 120 may cause the message display device 32 to display the appropriate message for the corresponding monitored fluid and the fluid level status in the manner described above.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A fluid level monitoring system for a machine having an onboard information system (OIS) configured to monitor a fluid level status for each of a plurality of fluids used in the operation of the machine, wherein the OIS stores a fluid level status value for each of the monitored fluids, the fluid level monitoring system comprising:

a control panel comprising:

a plurality of input devices, with each input device corresponding to one of the monitored fluids of the machine, a plurality of indicators, with each indicator corresponding to one of the input devices, wherein the input devices and indicators are operatively connected to the OIS, and wherein the indicators are configured to provide a visual display of a fluid level status for each of the monitored fluids; and a message display device comprising:

a display screen, and a processor operatively connected to the display screen and to the OIS, the processor being programmed to cause the display screen to display a fluid level status message for one of the monitored fluids, wherein the monitored fluid for which the fluid level status message is displayed is determined based on the actuation of the corresponding input device of the control panel; and at least one fill port corresponding to one of the monitored fluids, wherein each fill port is in fluid communication with a corresponding reservoir for the monitored fluid on the machine, and wherein the at least one fill port is disposed on the machine proximate the control panel and the message display device.

2. The fluid level monitoring system of claim 1, wherein the fluid level status message includes an indication of an amount of the monitored fluid to add to a reservoir for the monitored fluid on the machine when the fluid level status of the monitored fluid indicates that level of the monitored fluid is below a predetermined refill level.

3. The fluid level monitoring system of claim 1, wherein the fluid level status message includes an indication of an approved type of the monitored fluid to add to a reservoir for the monitored fluid on the machine when the fluid level status of the monitored fluid indicates that level of the monitored fluid is below a predetermined refill level.

4. The fluid level monitoring system of claim 1, wherein each control panel input device has three corresponding indicators, and wherein one indicator is illuminated when the corresponding monitored fluid has a fluid level status indicating that the level of the monitored fluid is below a predetermined refill level, two indicators are illuminated when the corresponding monitored fluid has a fluid level status indicating that the level of the monitored fluid is above the predetermined refill level and below a predetermined full level, and three indicators are illuminated when the corresponding monitored fluid has a fluid level status indicating that the level of the monitored fluid is above the predetermined full level.

5. The fluid level monitoring system of claim 1, wherein each control panel input device has a corresponding pictograph representing the corresponding monitored fluid, and wherein the fluid level status message includes a textual indication of the monitored fluid corresponding to the actuated control panel input device.

6. The fluid level monitoring system of claim 1, wherein each control panel input device has at least one corresponding indicator, with each indicator receiving signals from the OIS causing the indicators for each control panel input device to provide a visual output corresponding to the fluid level status for the corresponding monitored fluid, wherein actuation of one of the control panel input devices causes a signal to be transmitted from the control panel to the OIS, wherein the message display device processor receives a fluid level status message from the OIS after the actuation of the control panel input device, with the fluid level status message corresponding to the monitored fluid corresponding to the actuated control panel input device and to the fluid level status of the monitored fluid, and wherein the message display device processor causes the display screen to display the fluid level status message in response to receiving the fluid level status message from the OIS.

7. A machine having reservoirs for storing a plurality of fluids used in the operation of the machine, the machine comprising:

an onboard information system (OIS) comprising:

a plurality of fluid level sensors, each sensor being disposed at a reservoir for one of the fluids of the machine, a memory device configured to store a fluid level status for each of the fluids, and an OIS processor operatively connected to the memory device and the fluid level sensors, wherein the OIS processor is configured to receive signals from the fluid level sensors, to determine fluid level statuses for the fluids based on the signals received from the corresponding fluid level sensors, and to cause the memory device to store the fluid level statuses;

a control panel mounted on an exterior of the machine, the control panel comprising:

a plurality of input devices, with each input device corresponding to one of the fluids of the machine, and a plurality of indicators, with each indicator corresponding to one of the input devices, wherein the input devices and indicators are operatively connected to the OIS processor, and wherein OIS processor actuates the indicators to provide a visual display of the fluid level status for each of the fluids; and a message display device comprising:

a display screen, a message display device processor operatively connected to the display screen and to the OIS processor, the message display device processor being programmed to cause the display screen to display a fluid level status message for one of the monitored fluids, wherein the monitored fluid for which the fluid level status message is displayed is determined based on the actuation of the corresponding input device of the control panel; and at least one fill port corresponding to one of the fluids of the machine, wherein each fill port is in fluid communication with the corresponding reservoir for the fluid of the machine, and wherein the at least one fill port is disposed on the machine proximate the control panel and the message display device.

8. The machine of claim 7, wherein the fluid level status message includes an indication of an amount of the fluid to add to the reservoir for the fluid when the fluid level status of the fluid indicates that the level of the fluid is below a predetermined refill level.

9. The machine of claim 7, wherein the fluid level status message includes an indication of an approved type of fluid to add to the reservoir for the fluid when the fluid level status of the fluid indicates that the level of the fluid is below a predetermined refill level.

10. The machine of claim 7, wherein each control panel input device has three corresponding indicators, and wherein one indicator is illuminated when the corresponding fluid has a fluid level status indicating that the level of the fluid is below a predetermined refill level, two indicators are illuminated when the corresponding fluid has a fluid level status indicating that the level of the fluid is above the predetermined refill level and below a predetermined full level, and three indicators are illuminated when the corresponding fluid has a fluid level status indicating that the level of the fluid is above the predetermined full level.

11. The machine of claim 7, wherein each control panel input device has a corresponding pictograph representing the corresponding fluid, and wherein the fluid level status message includes a textual indication of the fluid corresponding to the actuated control panel input device.

12. The machine of claim 7, wherein at least one of the fluid level sensors comprises a continuous fluid level sensor.

13. The machine of claim 7, wherein the fluid level sensors comprise a fluid level full sensor and a fluid level add sensor disposed at the reservoir for one of the fluids, and wherein the OIS processor causes the memory device to store a fluid level status indicating that the reservoir for the fluid is full where the signal from the fluid level add sensor indicates that the fluid level is above a predetermined refill level and the signal from the fluid level full sensor indicates that the fluid level is above a predetermined full level, causes the memory device to store a fluid level status indicating that the reservoir for the fluid is not full and not at a refill level where the signal from the fluid level add sensor indicates that the fluid level is above the predetermined refill level and the signal from the fluid level full sensor indicates that the fluid level is below the predetermined full level, and causes the memory device to store a fluid level status indicating that the reservoir for the fluid needs to be refilled where the signal from the fluid level add sensor indicates that the fluid level is below the predetermined refill level.

14. The machine of claim 7, wherein the fluid level sensors comprise first and second fluid level add sensors and a fluid level full sensor disposed at the reservoir for one of the fluids, and the machine comprises an engine status sensor operatively coupled to the OIS processor and providing a signal indicative of an operational status of an engine of the machine, wherein the OIS processor causes the memory device to store a fluid level status indicating that the reservoir for the fluid is not at a refill level where the signal from the engine status sensor indicates that the engine is running and the signal from the first fluid level add sensor indicates that the fluid level is above a first predetermined refill level, causes the memory device to store a fluid level status indicating that the reservoir for the fluid needs to be refilled where the signal from the engine status sensor indicates that the engine is running and the signal from the fluid level add sensor indicates that the fluid level is below the first predetermined refill level, causes the memory device to store a fluid level status indicating that the reservoir for the fluid is full where the signal from the fluid level full sensor indicates that the fluid level is above a predetermined full level, causes the memory device to store a fluid level status indicating that the reservoir for the fluid is not full and not at the refill level where the signal from the engine status sensor indicates that the engine is not running and the signal from the second fluid level add sensor indicates that the fluid level is above a second predetermined refill level, and causes the memory device to store a fluid level status indicating that the reservoir for the fluid needs to be refilled where the signal from the engine status sensor indicates that the engine is not running and the signal from the second fluid level add sensor indicates that the fluid level is below the second predetermined refill level.

15. The machine of claim 7, wherein the indicators for the control panel input devices receive signals from the OIS processor causing the indicators to provide visual outputs corresponding to the fluid level statuses for the corresponding fluids stored at the memory device, wherein actuation of a control panel input device causes a signal to be transmitted from the control panel to the OIS processor, wherein the OIS processor transmits a fluid level status message to the message display device processor in response to receiving the signal from the actuated control panel input device, the fluid level status message corresponding to the fluid corresponding to the actuated control panel input device and the fluid level status of the fluid stored at the memory device, and wherein the message display device processor causes the display screen to display the fluid level status message in response to receiving the fluid level status message from the OIS processor.

16. A method for providing a fluid monitoring display at a fluid level monitoring system of a machine, comprising:

determining a fluid level status for each of a plurality of fluids used in the operation of the machine, wherein each fluid is contained within a corresponding reservoir of the machine having a corresponding fill port;

for each fluid, actuating at least one indicator of the fluid level monitoring system to provide a visual display corresponding to the fluid level status of the fluid, wherein the fill port for each fluid is disposed on the machine proximate the visual display;

detecting actuation of an input device of the fluid level monitoring system corresponding to one of the fluids; and causing a fluid level status message for the fluid to be displayed at a display screen of the fluid level monitoring system in response to the actuation of the input device corresponding to the fluid, wherein the fluid level status message corresponds to the fluid level status of the fluid, wherein the fill port for each fluid is disposed on the machine proximate the display screen.

17. The method of claim 16, wherein the fluid level status message includes an indication of an amount of the fluid to add to the corresponding reservoir for the fluid when the fluid level status indicates that the level of the fluid is below a predetermined refill level.

18. The method of claim 16, wherein the fluid level status message includes an indication of an approved type of fluid to add to the corresponding reservoir for the fluid when the fluid level status indicates that the level of the fluid is below a predetermined refill level.

19. The method of claim 16, wherein the fluid level monitoring system has three indicators corresponding to each fluid, and wherein the step of illuminating at least one indicator for each fluid comprises:

illuminating one indicator for a fluid when the corresponding fluid level status indicates that the level of the fluid is below a predetermined refill level;

illuminating two indicators for a fluid when the corresponding fluid level status indicates that the level of the fluid is above the predetermined refill level and below a predetermined full level; and illuminating three indicators when the corresponding fluid level status indicates that the level of the fluid is above the predetermined full level.

* * * * *